US010594088B2

(12) United States Patent
Cupples et al.

(10) Patent No.: US 10,594,088 B2
(45) Date of Patent: Mar. 17, 2020

(54) SHIELDED HIGH DENSITY JACK

(71) Applicant: Ortronics, Inc., New London, CT (US)

(72) Inventors: Kenneth Alan Cupples, New London, CT (US); Dylan Robert Petruskevicius, Willimantic, CT (US)

(73) Assignee: Ortronics, Inc., New London, CT (US)

( * ) Notice: Subject to any disclaimer, the term of this patent is extended or adjusted under 35 U.S.C. 154(b) by 0 days.

(21) Appl. No.: 16/196,923

(22) Filed: Nov. 20, 2018

(65) Prior Publication Data

US 2019/0157813 A1 May 23, 2019

Related U.S. Application Data

(60) Provisional application No. 62/589,320, filed on Nov. 21, 2017.

(51) Int. Cl.
*H01R 13/648* (2006.01)
*H01R 13/6593* (2011.01)
(Continued)

(52) U.S. Cl.
CPC ..... *H01R 13/6593* (2013.01); *H01R 13/502* (2013.01); *H01R 13/6582* (2013.01);
(Continued)

(58) Field of Classification Search
CPC ..... H01R 12/716; H01R 13/6596; H01R 13/6593; H01R 13/6582; H01R 13/465;
(Continued)

(56) References Cited

U.S. PATENT DOCUMENTS 4,603,936 A * 8/1986 Jagen ..... H01R 13/6592 439/354
4,641,901 A * 2/1987 Brennan ..... H01R 13/6581 439/344

(Continued)

OTHER PUBLICATIONS

U.S. Appl. No. 62/589,320, filed Nov. 21, 2017.

*Primary Examiner* — Abdullah A Riyami
*Assistant Examiner* — Vladimir Imas
(74) *Attorney, Agent, or Firm* — McCarter & English, LLP

(57) ABSTRACT

Advantageous electrical connector assemblies or jack assemblies/housings for use in communication systems are provided. The present disclosure provides systems/methods for the design and use of high density shielded modular electrical connectors that include improved shielding techniques. The present disclosure provides for a direct shielded connection throughout a shielded modular electrical connector. The shielded modular electrical connector provides for a single continuous contact with a shielded cable. The electrical connector assemblies are configured to facilitate a direct shielding connection that minimizes the connection path and provides a more direct connection to plug/cable and/or foil/cable ground wire and mounting panel. The shielding assembly includes a modular voice/data/video connector that further includes a modular plug contact and a wrap-around shield contact. The modular plug contact can include both cable shield contacts and plug contacts. The wrap-around shield contact can include a continuously formed material that captures a cable shield.

20 Claims, 10 Drawing Sheets

(51) Int. Cl.

| | |
|---|---|
| ***H01R 13/6596*** | (2011.01) |
| ***H01R 13/6582*** | (2011.01) |
| ***H01R 13/502*** | (2006.01) |
| *H01R 13/66* | (2006.01) |
| *H01R 4/2425* | (2018.01) |
| *H01R 13/506* | (2006.01) |
| *H01R 13/46* | (2006.01) |
| *H01R 24/64* | (2011.01) |
| *H01R 12/71* | (2011.01) |
| *H01R 13/518* | (2006.01) |

(52) U.S. Cl.
CPC ..... *H01R 13/6596* (2013.01); *H01R 4/2425* (2013.01); *H01R 12/716* (2013.01); *H01R 13/465* (2013.01); *H01R 13/506* (2013.01); *H01R 13/518* (2013.01); *H01R 13/6658* (2013.01); *H01R 24/64* (2013.01)

(58) Field of Classification Search
CPC .. H01R 13/502; H01R 13/506; H01R 13/518; H01R 13/6658; H01R 24/64
USPC ..... 439/607.28
See application file for complete search history.

(56) References Cited

U.S. PATENT DOCUMENTS 4,653,837 A * 3/1987 Phillipson ..... H01R 13/6599 439/607.38
5,219,294 A * 6/1993 Marsh ..... H01R 23/6873 439/607.28
5,222,909 A * 6/1993 Nomura ..... H01R 13/6582 439/271
5,267,875 A * 12/1993 Koegel ..... H01R 12/775 439/497
5,772,471 A * 6/1998 Buck ..... H01R 13/74 439/607.28
5,957,720 A * 9/1999 Boudin ..... H01R 24/64 439/409
6,764,342 B2 * 7/2004 Murayama ..... H01R 4/023 439/607.1
7,033,219 B2 * 4/2006 Gordon ..... H01R 9/032 439/607.41
7,083,472 B2 * 8/2006 Gordon ..... H01R 13/6589 439/607.41
7,758,383 B1 * 7/2010 Chantrell ..... H01R 9/035 439/462
7,857,663 B2 * 12/2010 Chantrell ..... H01R 13/506 439/607.41
8,002,572 B2 * 8/2011 Lu ..... H01B 7/0892 439/405
8,333,607 B1 * 12/2012 Moldoch ..... H01R 4/2433 439/367
8,376,779 B2 * 2/2013 Metral ..... H01R 13/502 439/607.41
8,439,702 B2 5/2013 Dietz et al.
8,628,351 B2 1/2014 Dietz et al.
8,672,709 B2 3/2014 Dietz et al.
8,834,196 B2 * 9/2014 Duran ..... H01R 9/032 439/459
9,627,827 B2 * 4/2017 Bragg ..... H01R 24/64
10,050,383 B2 * 8/2018 O'Young ..... H01R 13/6461
10,122,135 B2 * 11/2018 Trio ..... H01R 4/2416
2005/0277335 A1 * 12/2005 Gordon ..... H01R 13/6589 439/607.48

* cited by examiner

SHIELDED HIGH DENSITY JACK

CROSS-REFERENCE TO RELATED APPLICATIONS

This application claims the benefit of U.S. Provisional Applications entitled "Shielded High Density Jack," which was filed on Nov. 21, 2017, and assigned Ser. No. 62/589,320, the contents of which are herein incorporated by reference in their entirety.

FIELD OF THE DISCLOSURE

The present disclosure generally relates to electrical connector assemblies or jack assemblies/housings for use in communication systems (e.g., voice/data/video communication systems) and, more particularly, to high performance and high density shielded modular electrical connector assemblies that include improved shielding techniques.

BACKGROUND OF THE DISCLOSURE

In general, devices for interfacing with high frequency data transfer media are known. See, e.g., U.S. Pat. Nos. 8,333,607; 7,857,663 and 7,758,383, the entire contents of each being hereby incorporated by reference in their entireties.

Traditionally, shielding techniques for voice/data/video connectors utilize multiple connections, and perform separation of the shielded incoming cable wire from the foil. The multiple connections may result in additional shielding failures and over time increased contact resistance that may reduce shield performance. Furthermore, by separating the shielded incoming cable wire from the foil, the potential for degradation of the cable performance and impedance changes may result.

Additionally, to maintain contact to the cable shield during flex, conventional practice can utilize multiple parts/cable clamps/plastic ties, which may degrade performance over time (e.g., due to temperature cycling and increased contact resistance). Also, to overcome radio frequency interference/electromagnetic interference ("RFI/EMI"), conventional practice can utilize multiple components to connect with points spaced far apart relative to the frequency band performance.

An interest exists for improved electrical connector assemblies (e.g., shielded electrical connector assemblies), and related methods of use. These and other inefficiencies and opportunities for improvement are addressed and/or overcome by the assemblies, systems and methods of the present disclosure.

SUMMARY OF THE DISCLOSURE

The present disclosure provides advantageous electrical connector assemblies or jack assemblies/housings, and improved methods/systems for shielding the same. More particularly, the present disclosure provides improved shielding techniques/assembly for high performance and high density shielded modular electrical connector assemblies for communication systems (e.g., voice/data/video systems).

In exemplary embodiments, the present disclosure provides an advantageous shielding assembly or electrical connector assembly that is configured and adapted to minimize the connection path and provide a more direct connection to plug/cable and/or foil/cable ground wire and mounting panel. More particularly, the advantageous shielding assembly provides direct connection through a modular voice/data/video connector. As such, the present disclosure provides for a more direct shielding connection that reduces the potential for a substantial degradation of performance over time.

In an exemplary embodiment, the shielding assembly includes a modular voice/data/video connector that further includes a modular plug contact and a wrap-around shield contact. The modular plug contact may include both cable shield contacts and plug contacts. The wrap-around shield contact may include a continuously formed material that captures a cable shield. The modular plug contact and the wrap-around shield contact may be fabricated from a copper alloy or the like.

The present disclosure provides for a shielding assembly or electrical connector assembly including a connector housing having a locking member and a printed circuit board ("PCB") with plug connectors, the locking member described and disclosed in U.S. Pat. Nos. 8,672,709; 8,628,351 and 8,439,702, the entire contents of each being hereby incorporated by reference in their entireties.

The present disclosure provides for an electrical connector assembly having a housing, with a plug contact mounted with respect to a proximal face of the housing with the plug contact extending a length to the distal end of the housing; and having a cable shield or shielded connector with a wrap-around shield contact and a rear shield cap, the wrap-around shield contact and rear shield cap distally located from a portion of the plug contact, and when assembled, capture the cable shield or shielded connector; and a drain wire that captures the cable shield/shielded connector and interfaces with the wrap-around shield contact.

The present disclosure also provides for an electrical connector assembly wherein the shielded connector includes a wrap-around shield contact. The present disclosure also provides for an electrical connector wherein the drain wire connects a shielded cable to the wrap-around shield contact. The present disclosure also provides for a modular electrical connector wherein the plug contact connects the shielded connector to a mounting panel.

The present disclosure also provides for a modular electrical connector wherein the shielded connector accepts an unseparated shielded cable. The present disclosure also provides for a modular electrical connector wherein the wrap-around shield contact is a single wrap in continuous contact around the shield cable. The present disclosure also provides for a modular electrical connector wherein the wrap-around shield contact includes spring-like features to retain a cable.

The present disclosure also provides for a modular electrical connector wherein the wrap-around shield contact includes integrated hooks to capture the drain wire. The present disclosure also provides for a modular electrical connector wherein the shielded connector includes a cover with at least one of radio frequency interference and electromagnetic interface connections.

The present disclosure also provides for a modular electrical connector wherein the plug contact, drain wire, and wrap-around shield contact are formed from a copper alloy.

Any combination or permutation of embodiments is envisioned. Additional advantageous features, functions and applications of the disclosed systems, methods and assemblies of the present disclosure will be apparent from the description which follows, particularly when read in conjunction with the appended figures. All references listed in this disclosure are hereby incorporated by reference in their entireties.

BRIEF DESCRIPTION OF DRAWINGS

Features and aspects of embodiments are described below with reference to the accompanying drawings, in which elements are not necessarily depicted to scale.

Exemplary embodiments of the present disclosure are further described with reference to the appended figures. It is to be noted that the various features, steps and combinations of features/steps described below and illustrated in the figures can be arranged and organized differently to result in embodiments which are still within the scope of the present disclosure.

Figure 1:
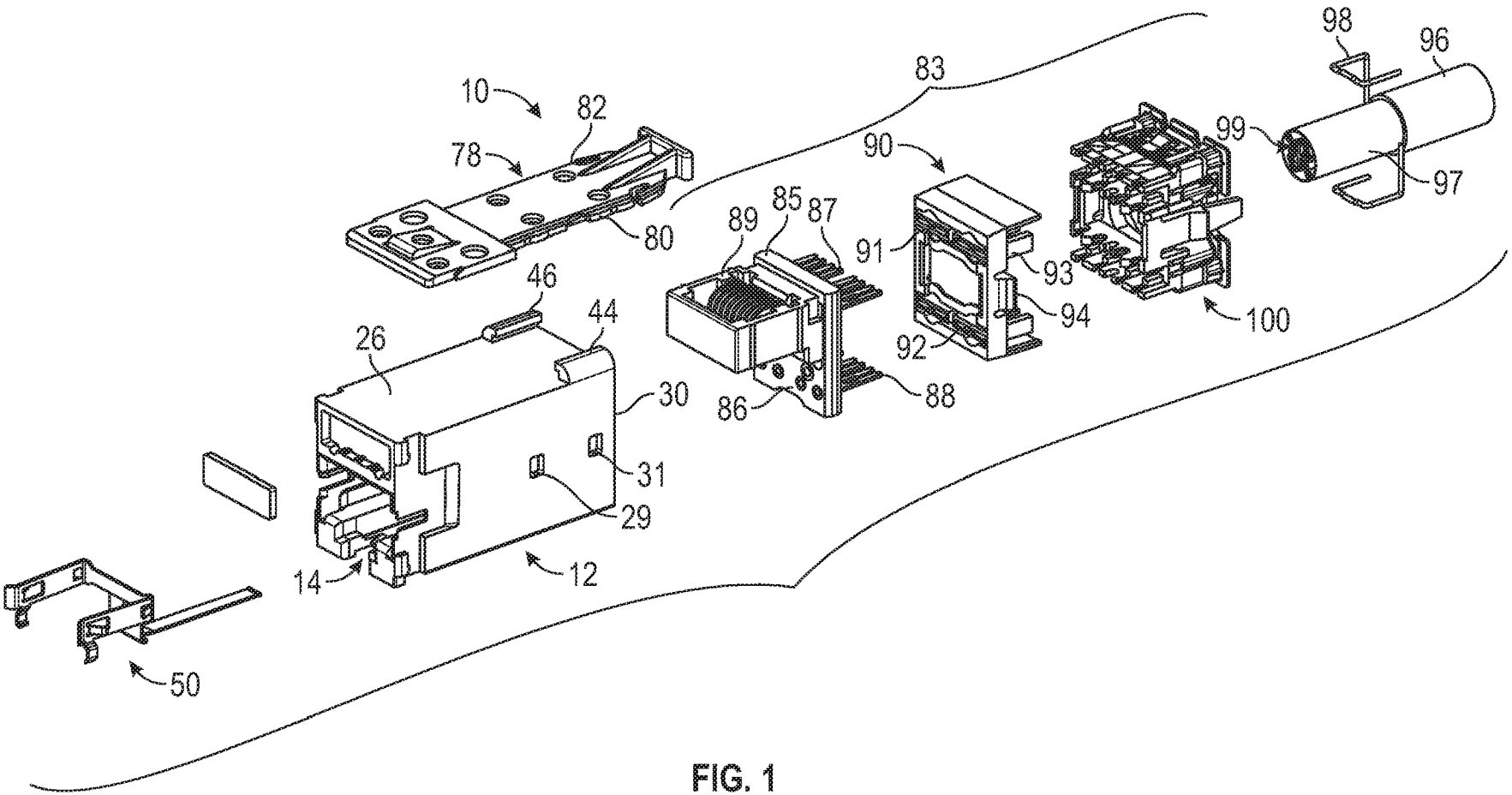
Figure 1A:
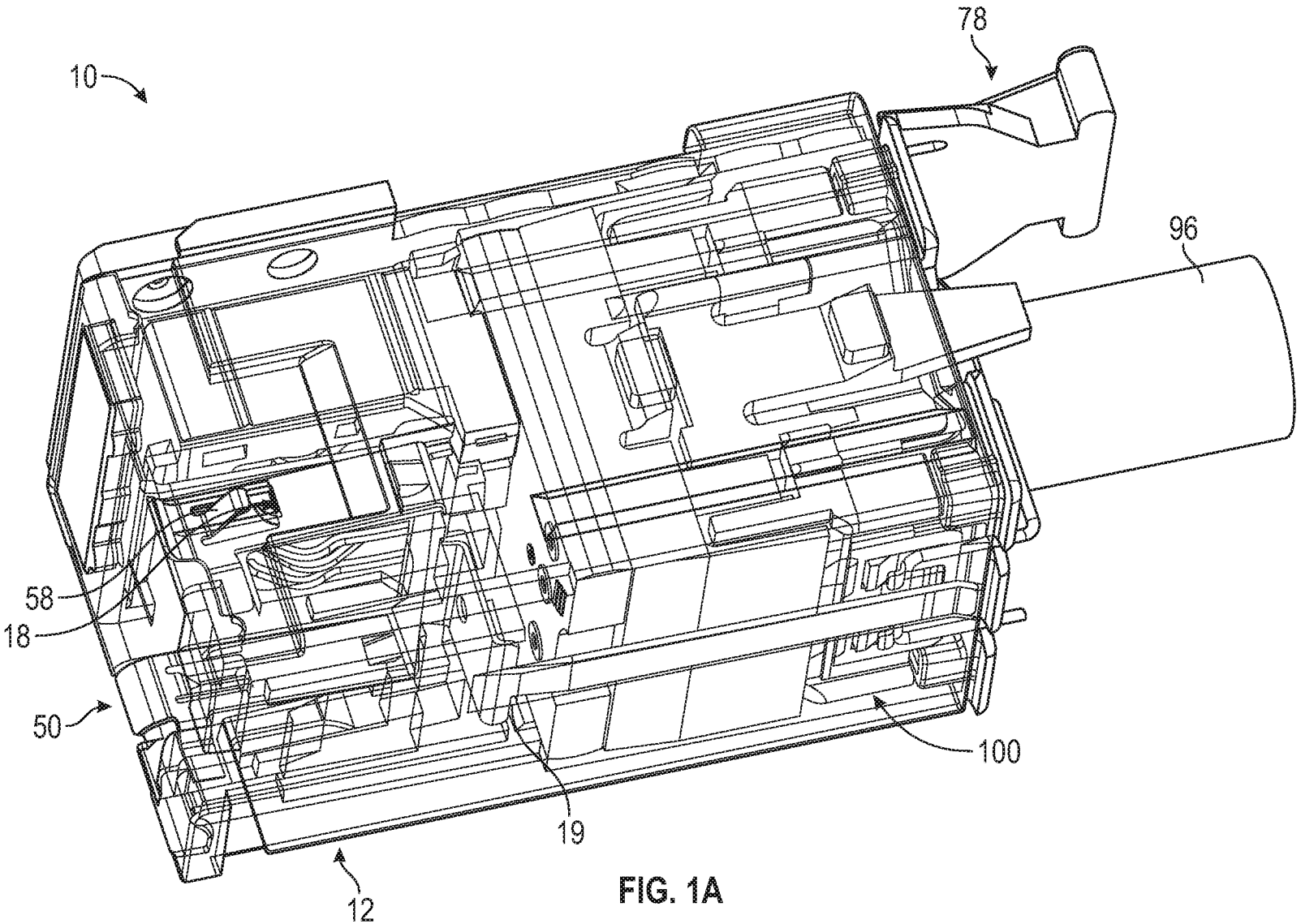
Figure 2:
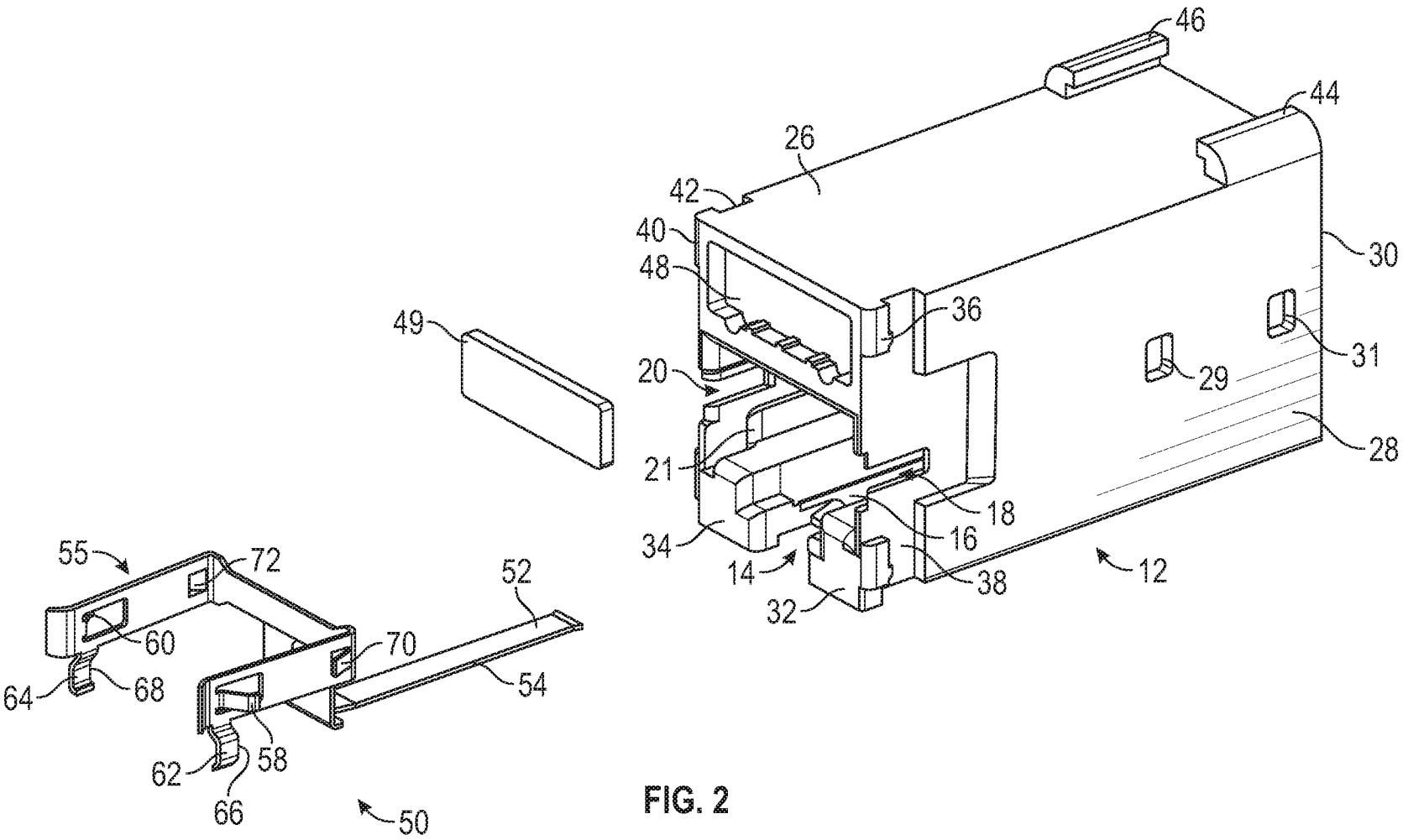
Figure 3:
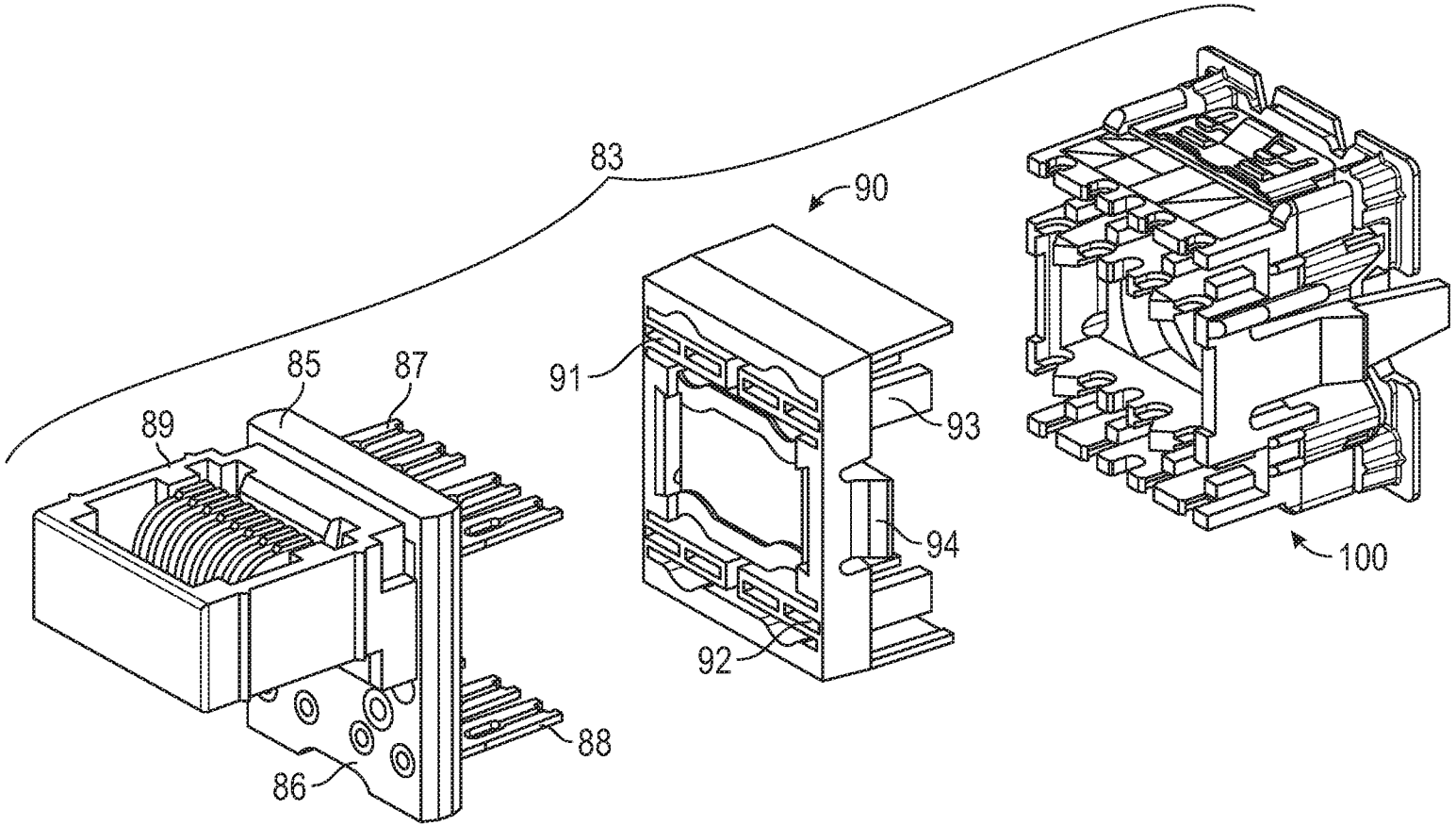
Figure 4:
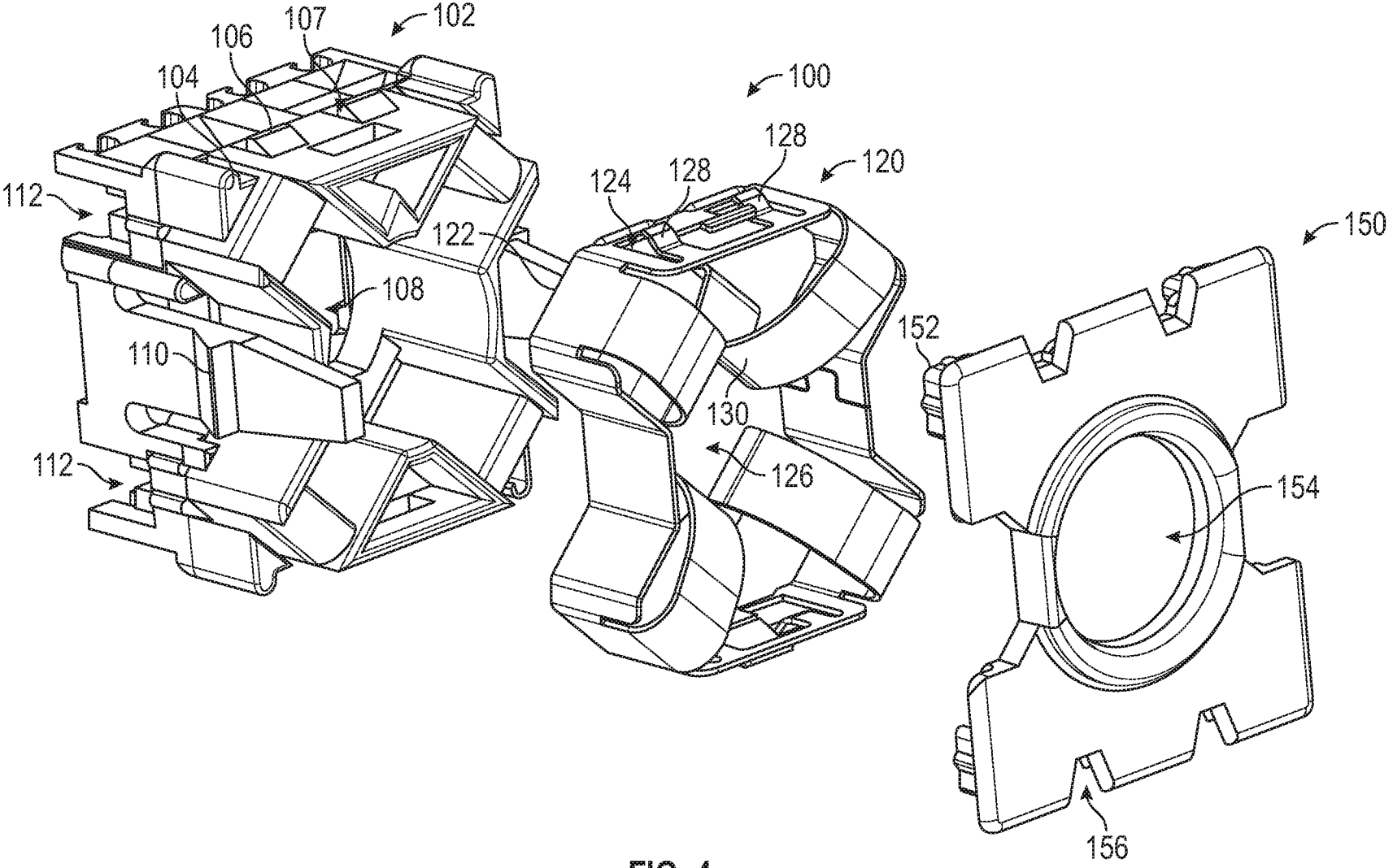
Figure 5:
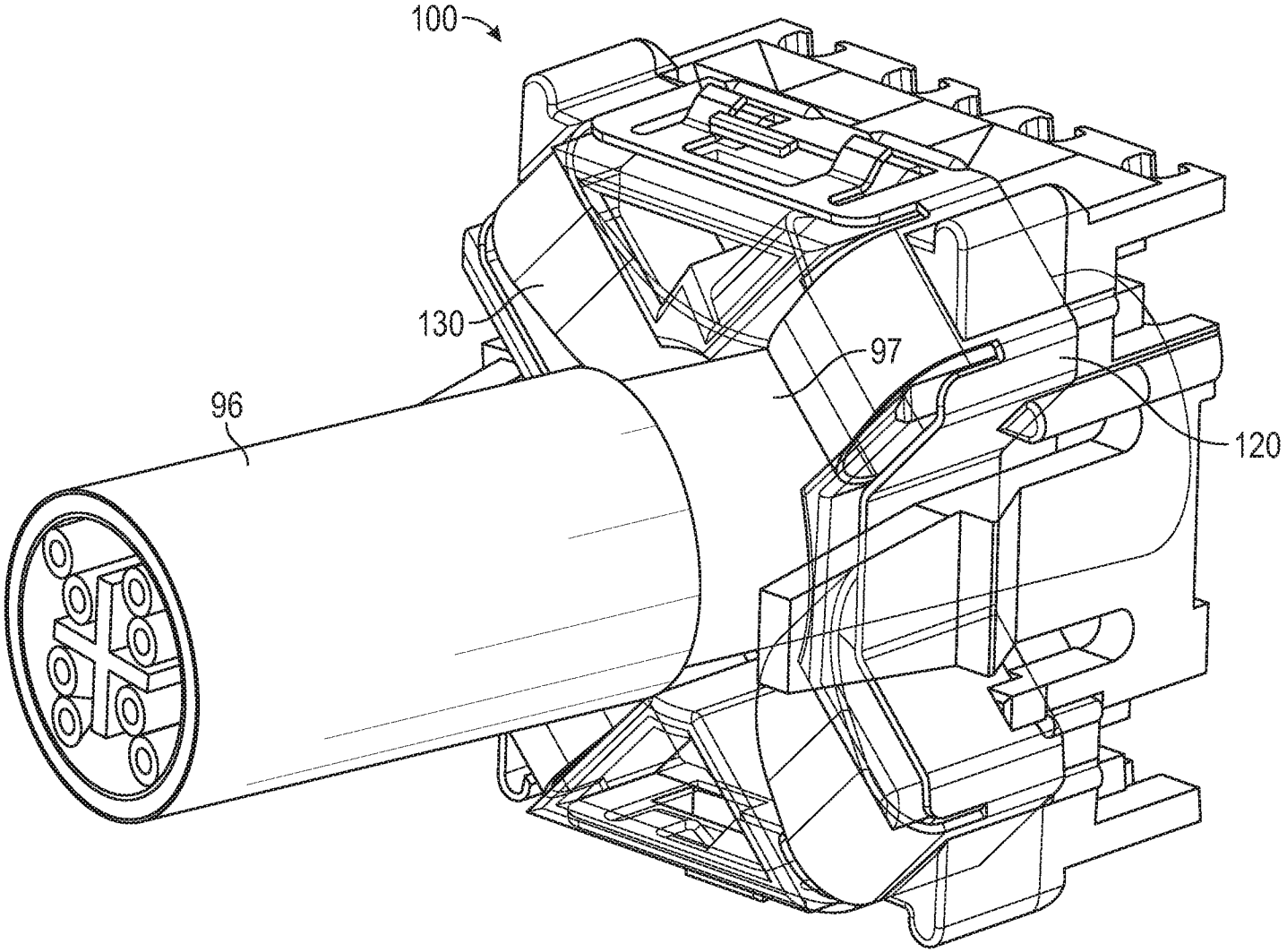
Figure 6:
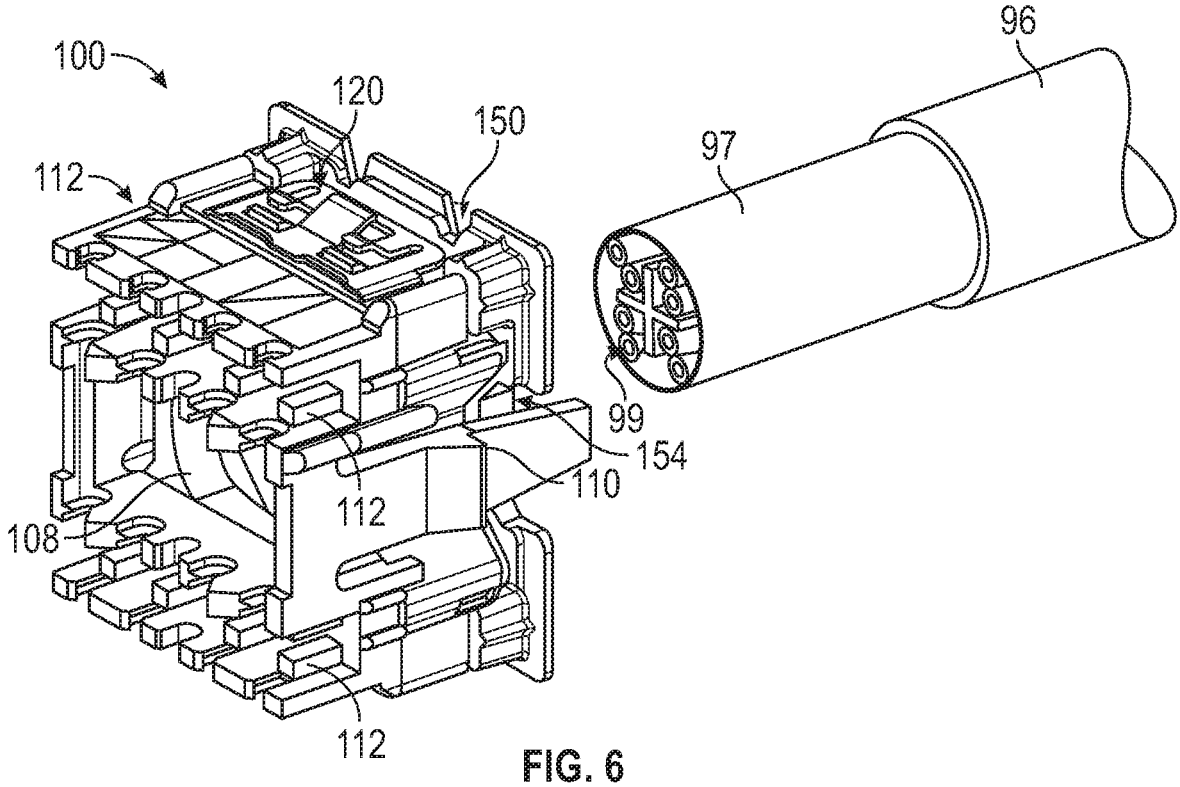
Figure 6A:
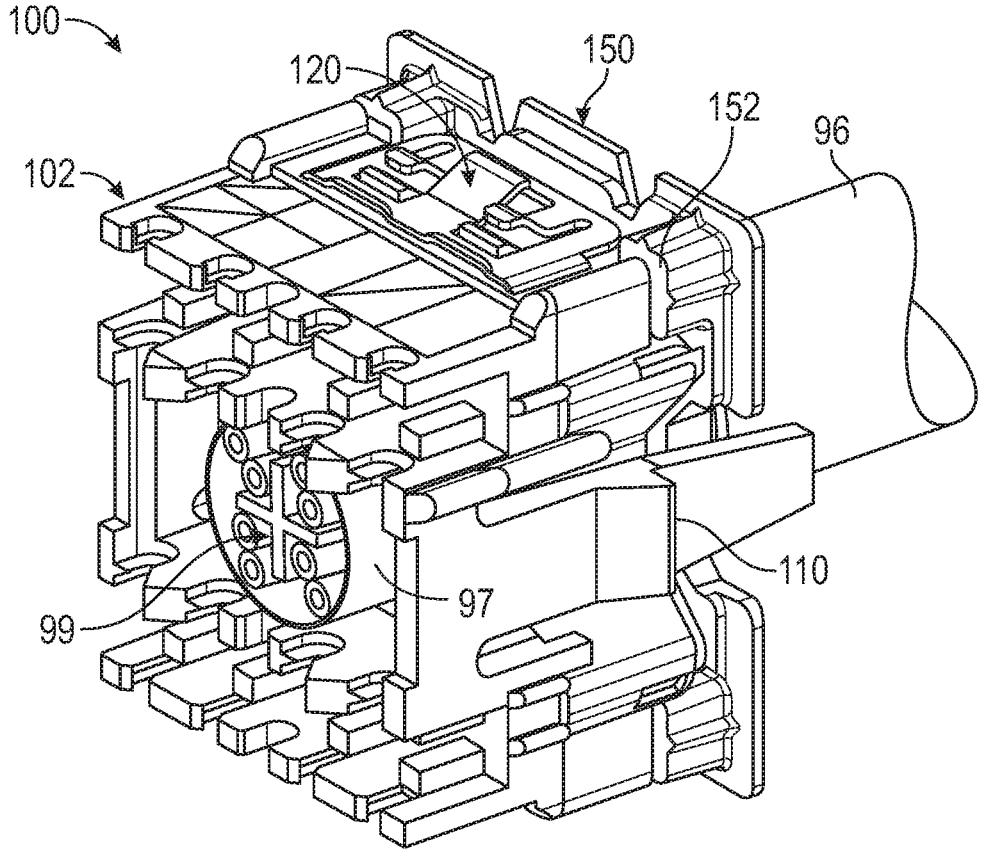
Figure 7:
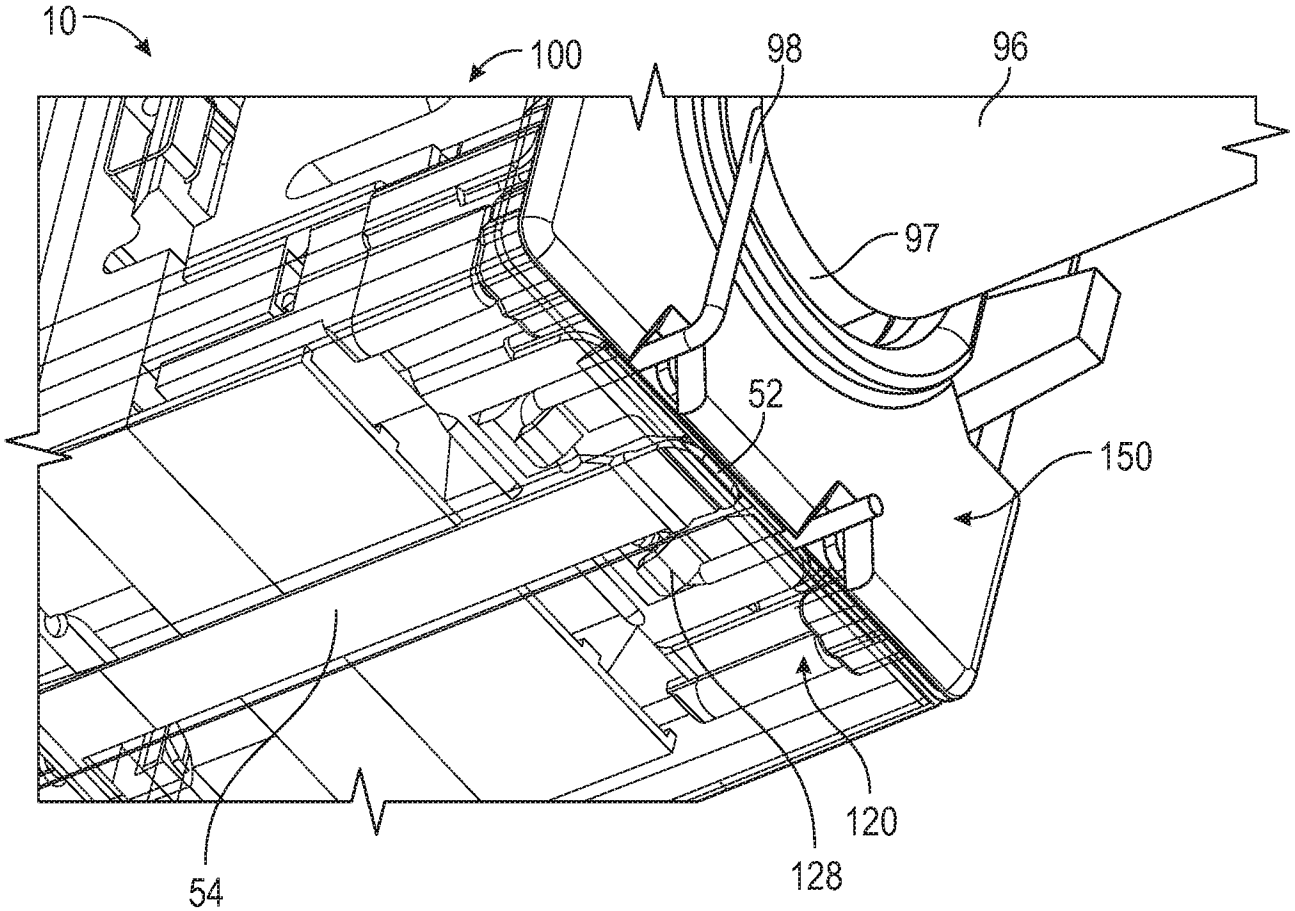
Figure 8:
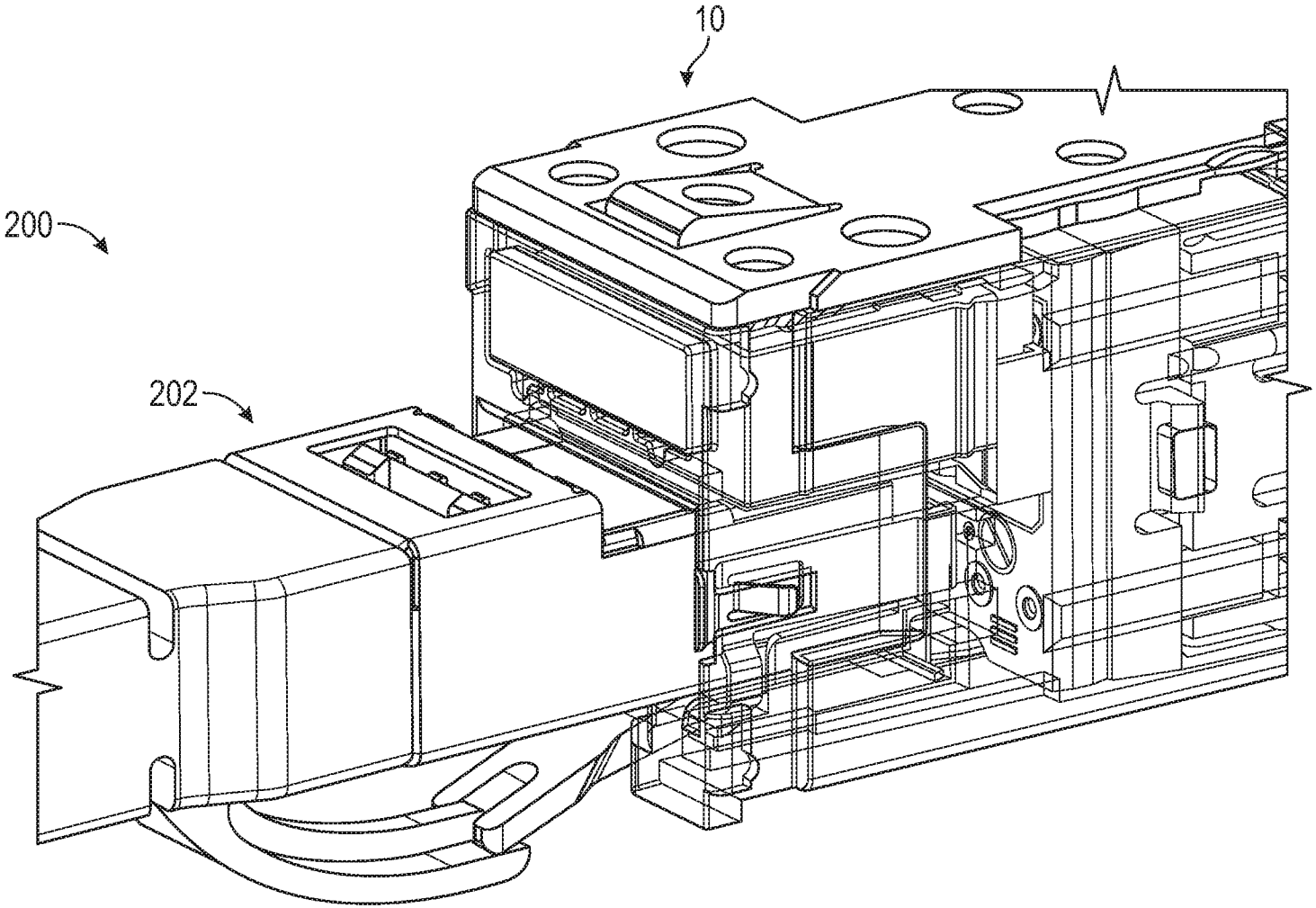
Figure 9:
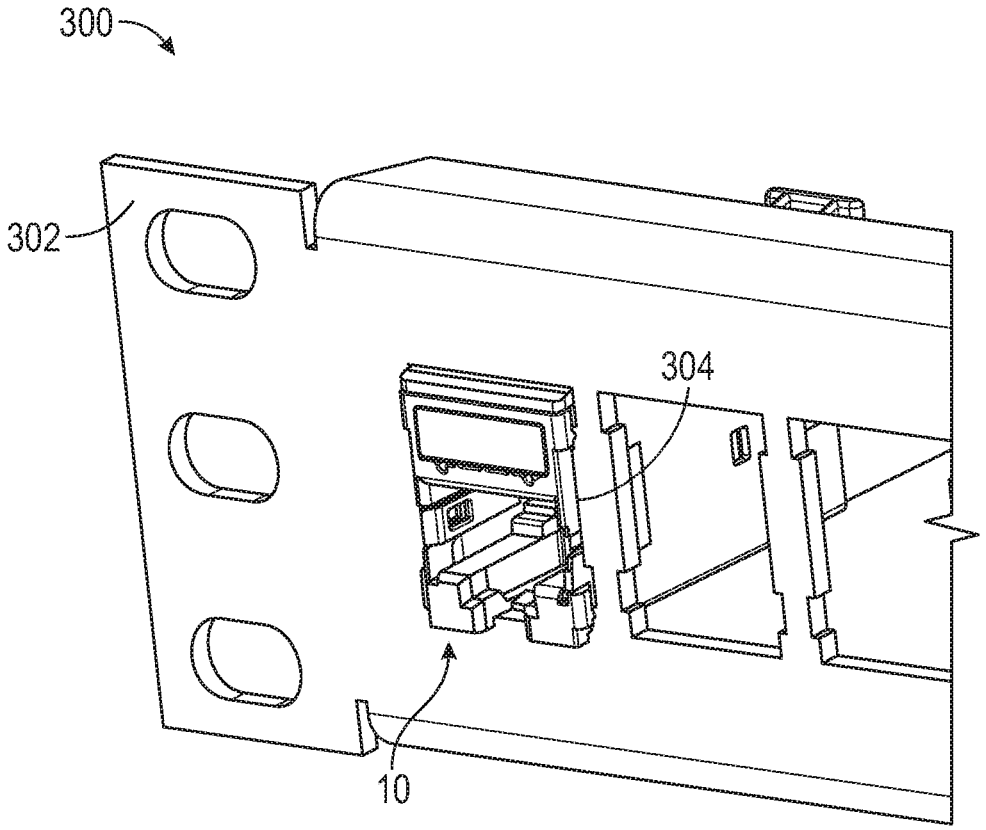

To assist those of ordinary skill in the art in making and using the disclosed assemblies, systems and methods, reference is made to the appended figures, wherein:

FIG. 1 schematically depicts an exploded perspective view of an exemplary electrical connector assembly, according to the present disclosure;

FIG. 1A schematically depicts an assembled perspective view of an exemplary electrical connector assembly, according to the present disclosure;

FIG. 2 schematically depicts certain components of an exemplary electrical connector assembly, according to the present disclosure;

FIG. 3 schematically depicts certain components of an exemplary electrical connector assembly, according to the present disclosure;

FIG. 4 schematically depicts an exploded perspective view of a shielded connector, according to the present disclosure;

FIG. 5 schematically depicts an assembled perspective view of an exemplary shielded connector, according to the present disclosure;

FIG. 6 schematically depicts an assembled perspective view of an exemplary shielded connector and an unattached cable, according to the present disclosure;

FIG. 6A schematically depicts an assembled perspective view of an exemplary shielded connector and attached cable, according to the present disclosure;

FIG. 7 schematically depicts an assembled partial perspective view of an exemplary electrical connector assembly, according to the present disclosure;

FIG. 8 schematically depicts an assembled partial perspective view of an exemplary electrical connector assembly and mating connector, according to the present disclosure; and FIG. 9 schematically depicts an assembled perspective view of an exemplary electrical connector assembly and mounting panel, according to the present disclosure.

DETAILED DESCRIPTION OF DISCLOSURE

The exemplary embodiments disclosed herein are illustrative of advantageous shielding assemblies (e.g., modular electrical connector shielding assemblies), and systems of the present disclosure and methods/techniques thereof. It should be understood, however, that the disclosed embodiments are merely exemplary of the present disclosure, which may be embodied in various forms. Therefore, details disclosed herein with reference to exemplary assemblies/fabrication methods and associated processes/techniques of assembly and use are not to be interpreted as limiting, but merely as the basis for teaching one skilled in the art how to make and use the advantageous assemblies/systems (e.g., modular electrical connector shielding assemblies) and/or alternative assemblies of the present disclosure.

The present disclosure provides improved shielding assemblies (e.g., modular connector shielding assemblies), and advantageous methods/systems for using the same. More particularly, the present disclosure provides advantageous systems/methods for the design and use of modular electrical connector assemblies configured to facilitate a more direct shielding connection that minimizes the connection path and provides a more direct connection to plug/cable and/or foil/cable ground wire and mounting panel.

In exemplary embodiments, the shielding assembly or electrical connector assembly includes a modular voice/data/video connector that further includes a modular plug contact and a wrap-around shield contact. The modular plug contact may include both cable shield contacts and plug contacts.

The wrap-around shield contact may include a continuously formed material that captures a cable shield or shielded connector. The modular plug contact and the wrap-around shield contact may be fabricated from a copper alloy. The shielding assembly or electrical connector assembly further includes a shielded connector that may reduce the disturbance of the shielded cable during cable preparation and assembly. Such reduction in disturbance may be accomplished by inserting the cable into the shielded connector without separating the cable into wire pairs. A rear cap of the shielded connector may also include one or more RF/EMI connection points.

Some related assemblies and systems in this general field are described and disclosed in the following disclosures: (i) U.S. Pat. No. 8,672,709, entitled "High Density Jack," which issued on Mar. 18, 2014; (ii) U.S. Pat. No. 8,628,351, entitled "High Density Jack," which issued on, Jan. 14, 2014; (iii) U.S. Pat. No. 8,439,702, entitled "High Density Jack," which issued on May 14, 2013; (iv) U.S. Pat. No. 8,333,607, entitled "Connector With Pivotable Wings, A Locking Cam Nut And A Deflectable Contact Ring," which issued on Dec. 18, 2012; (v) U.S. Pat. No. 7,857,663, entitled "Connector Assemblies, Combinations And Methods For Use With Foil-Shielded Twisted Pair Cables," which issued on Dec. 28, 2010; and (vi) U.S. Pat. No. 7,758,383, entitled "Connector Assemblies, Combinations And Methods For Use With Foil-Shielded Twisted Pair Cables," which issued on Jul. 20, 2010. The entire contents of the foregoing issued patents are incorporated herein by reference.

Referring now to the drawings, like parts are marked throughout the specification and drawings with the same reference numerals, respectively. Drawing figures are not necessarily to scale and in certain views, parts may have been exaggerated for purposes of clarity.

FIG. 1 schematically depicts a shielded high density jack assembly or electrical connector assembly 10 that is configured and adapted to provide a direct shielding connection to a plug/cable and/or foil/cable ground wire and mounting panel. FIG. 1A depicts an assembled shielded high density jack assembly or electrical connector assembly 10 of FIG. 1.

In an exemplary embodiment, high density jack assembly or electrical connector assembly 10 includes housing 12 (e.g., jack housing 12 or jack connector housing 12) that further includes plug contact 50 incorporated or mounted therein. Housing 12 includes various attachment mechanisms, e.g., slots, cavities, channels, etc., each of which will be discussed in relation to the mating components of shielded high density jack assembly or electrical connector assembly 10.

FIG. 2, in view of FIGS. 1 and 1A, depicts plug contact 50 and housing 12 in an exploded and magnified view. Exemplary plug contact 50 is a biplanar component with a substantially U-shaped bracket 55 on the top plane and contact 52 on the lower plane.

Contact 52 of plug contact 50 is longitudinally introduced into cavity 14 of housing 12. Base 54 of contact 52 initially interfaces with surface 16 of housing 12 before interfacing with channel 19.

As plug contact 50 is further introduced into housing 12, retaining tabs 70, 72 of plug contact 50 interface with the inside wall of housing 12. Exemplary tabs 70, 72 are tapered for easy installation, but once engaged with inside wall of housing 12, they restrict longitudinal and/or rotational movement of plug contact 50.

In contrast, exemplary tabs 58, 60 when introduced with housing 12 remain in slots 18, 20, respectively. Once installed with housing 12, tabs 58, 60 extend outward from surfaces 38, 42 of housing 12, respectively, and may engage with a mounting panel, or the like (see FIG. 9).

Plug contact 50 is fully introduced into housing 12 when surfaces 66, 68 of braces 62, 64, respectively, are engaged with surface 21 (opposing surface hidden) of housing 12. Exemplary braces 62, 64 are substantially perpendicular to U-shaped bracket 55 and extend towards the lower plane with contact 52. As such, plug contact 50 is configured to be attached to a proximal face of housing 12. In an exemplary embodiment, plug contact 50 is formed from a copper alloy, however, additional materials may be utilized. Label 49 or the like may interface with surface 48 of housing 12 to provide explanations, as necessary.

In an exemplary embodiment and with reference to FIGS. 1 and 3, connection interface sub-assembly 83 may be an insulation displacement connector sub-assembly that includes insulation displacement contacts (IDCs) 87, 88 disposed on one side of a circuit board 85. IDCs 87, 88 may be used for connecting to and/or terminating wires and cables. IDCs 87, 88 can be made from a conductive material (e.g., spring like copper alloy; high strength copper alloy; etc.) and can be configured to grip wires that are pushed between tines of the IDCs 87, 88 so that the conductor of the wire contacts the tines. The circuit board 85 can receive other electrical elements 89, such as a plug or socket.

Connection interface sub-assembly 83 can include a cover 90, which may receive IDCs 87, 88 in receiving cavities 91, 92, respectively. In an exemplary embodiment, signals may transfer from a plug connector or the like introduced to receiving space 14 of housing 12 to printed circuit board ("PCB") 85 and then to IDCs 87, 88, thus completing the data interface and transfer through shielded high density jack assembly or electrical connector assembly 10.

Feature/cutout 86 of PCB 85 provides a cutout or path for plug contact 50, see FIG. 1A. Cover 90 is substantially similar in shape, e.g., square, rectangular, etc., to the interior shape of housing 12, thereby restricting rotational movement. Once PCB 85 and cover 90 are fully inserted into the cavity of housing 12, tabs 94 of cover 90 may engage with slot 29 of housing 12, thereby restricting longitudinal movement of PCB 85 and cover 90.

In view of FIGS. 4, 5, 6, and 6A (collectively referred to as FIGS. 4-6), and in further view of FIGS. 1 and 3, shielded connector 100 includes housing 102, wrap-around shield contact 120, and cover 150.

Tabs 93 of cover 90 interact with corresponding receiving cavities 112 of housing 102, thereby assisting in aligning the components and restricting rotational movement of housing 102. Housing 102 includes retention tabs 110 for engagement with slot 31 (through surface 28) of distal end 30 of housing 12, see FIGS. 1, 1A and 4.

Housing 102 includes a substantially X-shaped feature 104 that extends past the plane created by surface 104. The substantially X-shaped feature 104 includes a cavity 108 located at or near the center of X-shaped feature 104 and housing 102. Cavity 108 may be any shape in order to receive cable 96, however, a circular cavity 108 is preferred. The substantially X-shaped feature 104 of housing 102 references the interior profile of wrap-around shield contact 120, discussed in more detail below.

Wrap-around shield contact 120 interfaces with the corresponding substantially X-shaped feature 104 of housing 102. Upon aligning the X-shaped features of each component, proximal face 122 of wrap-around shield contact 120 may rest on and/or in close proximity to surface 104 of housing 102. Wrap-around shield contact 120 encapsulates the substantially X-shaped feature of 104 housing 102.

Upon installation, cavity 126 of wrap-around shield contact 120 may be substantially concentric with cavity 108 of housing 102. Tab receiving cavities 124 of wrap-around shield contact 120 capture tabs 106 of housing 102 for further retention. Tabs 106 are tapered towards proximal face 122 of wrap-around shield contact 120 for easy installation into tab receiving cavities 124, however, upon installation, the substantially perpendicular face 107 snaps or retains within tab receiving cavities 124. Tabs 106 may be positioned on any side wall of housing 102. In an exemplary embodiment, tabs 106 are located on the sides adjacent retention tabs 110 and include at least one tab 106 on either side wall, however, at least two tabs 106 can be utilized. Integrated hooks 128 may be angled towards proximate face 122 for retention of the drain wire, discussed in more detail below.

Wrap-around shield contact 120 includes spring-like features 130 that extend into cavity 126 and further constrict the opening area 126. In exemplary embodiments, four spring-like features 130 extend into cavity 126, however, more or less spring-like features may be utilized without departing from the spirit/scope of this disclosure.

As depicted in FIG. 5, where the components of shielded connector 100 are transparent to view wrap-around shield contact 120, spring-like features 130 expand to capture and retain shielded cable 97 of cable 96. Wrap-around shield contact 120 may be formed from a copper alloy, however, other like materials can be utilized. Spring-like features 130 are configured to maintain contact with shielded cable 97 no matter how the cable 96 is flexed from the rear.

Cover 150 further includes a cavity 154 that is concentrically aligned with cavities 126, 108 upon installation. Cover 150 is press-fit over wrap-around shield contact 120 and interfaces with housing 102. Particularly, proximal edge 152 of cover 150 rests on and/or in close proximity to surface 104 of housing 102. Upon installation, shielded connector 100 may accept cable 96, as depicted in FIGS. 5-6A. Cut-outs 156 of cover 150 allow for installation of the drain wire 98, as discussed in more detail below. Cover 150 further may include connection points to the main radio frequency interference/electromagnetic interference ("RFI/EMI") enclosure of the connector. These points may be spaced systematically in order to tune RFI/EMI shield performance for certain frequency bands.

As discussed above, tabs 110 of shielded connector 100 may be inserted into slots 31 of housing 12. Upon doing so, shielded high density jack 10 is assembled, which includes housing 12, plug contact 50, connection interface sub-assembly 83, and shielded connector 100. Additional components and/or variations of the above may be incorporated without departing from the scope/focus of the disclosure.

In operation, with reference to FIGS. 1, 1A, 5, 6 and 6A, shielded cable 97 is inserted into cavity 154 of cover 150 and subsequently through the cavities of wrap-around shield contact 120 and housing 102. As noted in FIG. 6A, wires 99 are not separated from each other, which is opposite from conventional practice (which separates the wires). Separation of wires 99 from the foil into shielded pairs may degrade the cable performance and cause impedance changes. Further, the separation of wires 99 creates extra connection points from cable shield 97 to wrap-around shield contact 120.

Instead, shielded cable 97 is inserted into and captured by spring-like features 130 which provide a direct connection between cable 96, shielded high density jack 10, and mounting panel 302. The single connection (e.g., wrap-around shield contact 120) eliminates the extra connections that provide additional shield connection failure modes and increased contact resistance over time that can further reduce shield performance.

Furthermore, as shown in FIG. 7, drain wire 98 wraps around and/or is attached to shielded cable 97 which is directly connected to wrap-around shield contact 120. Drain wire 98 is further in direct contact with hooks 128 on wrap-around shield contact 120. Drain wire 98 may be installed on the inside of and/or on the outside of cover 150. Drain wire 98 may be fabricated from a copper alloy and/or another conductive material. Utilizing a single connection to shielded cable 97, e.g., drain wire 98, reduces the potential for performance degradation over time due to temperature cycling and increased contact resistance.

Also, contact 52 on lower plane of plug contact 50 is further connected with wrap-around shield contact 120. Doing so directly connects shielded cable 97 and wrap-around shield contact 120 with plug contact 50 for substantially complete shielding.

With reference to FIG. 8, assembly 200 includes shielded high density jack or electrical connector assembly 10 and mating connector 202. Connector 202 interfaces with plug contact 50 of housing 12, which, as mentioned above, is substantially completely shielded to shielded cable 97.

With reference to FIG. 9, assembly 300 further includes shielded high density jack or electrical connector assembly 10 mounted within mounting panel 302. Doing so directly connects shielded cable 97 with mounting panel 302. Tabs 58, 60 of plug contact 50 facilitate low resistance contact with the panel 302 for shielding.

Shielded high density jack or electrical connector assembly 10 is retained in mounting panel 302 by flanges 32, 34, 36, 40 interfaced with opening 304 (FIGS. 2 and 9), in combination with the movable locking member 78 on surface 26 and with extensions 80, 82 partially under rails 44, 46 (FIG. 2), as described and disclosed in U.S. Pat. Nos. 8,439,702 and 8,672,709, the entire contents of each being hereby incorporated by reference in their entireties.

In certain embodiments, it is noted that housing 12 can be fabricated from metal or the like. As such, housing 12 can take the form of a solid single-piece metal housing 12 that provides wrap-around shielding (e.g., 360 degree shielding) of the shielded connector 100, plug contact 50 and/or the shielded cable 97 connection.

Although the systems and methods of the present disclosure have been described with reference to exemplary embodiments thereof, the present disclosure is not limited to such exemplary embodiments and/or implementations. Rather, the systems and methods of the present disclosure are susceptible to many implementations and applications, as will be readily apparent to persons skilled in the art from the disclosure hereof. The present disclosure expressly encompasses such modifications, enhancements and/or variations of the disclosed embodiments. Since many changes could be made in the above construction and many widely different embodiments of this disclosure could be made without departing from the scope thereof, it is intended that all matter contained in the drawings and specification shall be interpreted as illustrative and not in a limiting sense. Additional modifications, changes, and substitutions are intended in the foregoing disclosure. Accordingly, it is appropriate that the appended claims be construed broadly and in a manner consistent with the scope of the disclosure.

What is claimed is:

1. An electrical connector assembly comprising:

a housing;

a plug contact attached to a proximal face of the housing, the plug contact extending to a distal end of the housing;

a connection interface sub-assembly mounted within the housing;

a shielded connector mounted distally with the housing, the shielded connector including a housing having outer walls with features, and the shielded connector including a wrap-around shield contact with spring-like features configured to retain a shielded cable, the wrap-around shield contact encapsulating the features on the outer walls of the housing of the shielded connector during engagement of the wrap-around shield contact with the housing of the shielded connector; and a drain wire attached to the shielded connector;

wherein the shielded connector is directly connected to the plug contact.

2. The assembly of claim 1, wherein the features of the housing of the shielded connector define an X-shaped configuration, and the wrap-around shield contact of the shielded connector defines a corresponding X-shaped configuration.

3. The assembly of claim 1, wherein the drain wire connects the shielded cable to the wrap-around shield contact.

4. The assembly of claim 1, wherein the plug contact is configured to connect the shielded connector to a mounting panel.

5. The assembly of claim 1, wherein the shielded connector is configured and dimensioned to accept an unseparated shielded cable.

6. The assembly of claim 1, wherein the wrap-around shield contact is a single wrap in continuous contact around the shielded cable.

7. The assembly of claim 1, wherein the wrap-around shield contact includes cavities and the housing of the shielded connector includes tabs along the outer walls, the cavities of the wrap-around shield contact configured to receive and retain the tabs of the housing of the shielded connector.

8. The assembly of claim 1, wherein the wrap-around shield contact includes integrated hooks to capture the drain wire.

9. The assembly of claim 1, wherein the shielded connector includes a cover with at least one of radio frequency interference and electromagnetic interface connections.

10. The assembly of claim 1, wherein the plug contact is fabricated from a copper alloy.

11. The assembly of claim 1, wherein the drain wire is fabricated from a copper alloy.

12. The assembly of claim 1, wherein the wrap-around shield contact is fabricated from a copper alloy.

13. The assembly of claim 1, wherein the plug contact is a bi-planar component with a substantially U-shaped bracket on a top plane of the plug contact and a contact on a lower plane of the plug contact.

14. The assembly of claim 1, wherein the housing is a solid single-piece metal housing, the housing providing wrap-around shielding of the shielded connector, the plug contact and a shielded cable connection.

15. The assembly of claim 14, wherein the housing provides 360 degree shielding of the shielded connector, the plug contact and the shielded cable connection.

16. An electrical connector assembly comprising:

a housing;

a plug contact attached to a proximal face of the housing, the plug contact extending to a distal end of the housing;

a connection interface sub-assembly mounted within the housing;

a shielded connector mounted distally with the housing, the shielded connector including a housing having outer walls with features, and the shielded connector including a wrap-around shield contact with spring-like features configured to retain a shielded cable, the wrap-around shield contact encapsulating the features on the outer walls of the housing of the shielded connector during engagement of the wrap-around shield contact with the housing of the shielded connector; and a drain wire attached to the shielded connector;

wherein the shielded connector is directly connected to the plug contact;

wherein the drain wire connects the shielded cable to the wrap-around shield contact; and wherein the wrap-around shield contact is a single wrap in continuous contact around the shielded cable.

17. The assembly of claim 16, wherein the plug contact is configured to connect the shielded connector to a mounting panel; and wherein the plug contact is a bi-planar component with a substantially U-shaped bracket on a top plane of the plug contact and a contact on a lower plane of the plug contact.

18. The assembly of claim 16, wherein the shielded connector is configured and dimensioned to accept an unseparated shielded cable.

19. The assembly of claim 16, wherein the wrap-around shield contact includes cavities and the housing of the shielded connector includes tabs along the outer walls, the cavities of the wrap-around shield contact configured to receive and retain the tabs of the housing of the shielded connector.

20. The assembly of claim 16, wherein the wrap-around shield contact includes integrated hooks to capture the drain wire; and wherein the shielded connector includes a cover with at least one of radio frequency interference and electromagnetic interface connections.

* * * * *